US007927164B2

(12) United States Patent
Kuchler

(10) Patent No.: US 7,927,164 B2
(45) Date of Patent: Apr. 19, 2011

(54) UNDERWATER VIEWING UNIT FOR AN AIR MATTRESS

(76) Inventor: Marcus Kuchler, Munich (DE)

( * ) Notice: Subject to any disclaimer, the term of this patent is extended or adjusted under 35 U.S.C. 154(b) by 574 days.

(21) Appl. No.: 11/993,330

(22) PCT Filed: Jun. 22, 2006

(86) PCT No.: PCT/EP2006/006019

§ 371 (c)(1),
(2), (4) Date: Jan. 30, 2008

(87) PCT Pub. No.: WO2006/136416

PCT Pub. Date: Dec. 28, 2006

(65) Prior Publication Data

US 2010/0062665 A1 Mar. 11, 2010

(30) Foreign Application Priority Data

Jun. 23, 2005 (DE) ..... 20 2005 009 896 U

(51) Int. Cl.
*B63C 11/00* (2006.01)

(52) U.S. Cl. ..... 441/135; 114/66

(58) Field of Classification Search ..... 114/66; 441/135; 359/665, 895
See application file for complete search history.

(56) References Cited

U.S. PATENT DOCUMENTS

| | | | | |
|---|---|---|---|---|
| 2,712,139 | A * | 7/1955 | Kelly | 441/135 |
| 2,717,399 | A * | 9/1955 | Backhouse | 441/135 |
| 3,081,726 | A * | 3/1963 | Betts | 114/66 |
| 4,691,658 | A * | 9/1987 | New et al. | 114/66 |
| 4,844,595 | A * | 7/1989 | Nealy | 441/135 |
| 4,925,417 | A * | 5/1990 | Warren | 441/135 |
| 5,476,055 | A | 12/1995 | Hackett et al. | |
| 5,672,082 | A * | 9/1997 | Binder | 441/135 |
| 6,241,569 | B1 * | 6/2001 | Harkrider | 441/135 |
| 7,547,238 | B1 * | 6/2009 | Melancon | 441/135 |
| 7,691,079 | B2 * | 4/2010 | Gobel | 604/96.01 |

FOREIGN PATENT DOCUMENTS

| | | |
|---|---|---|
| DE | 203 15 281 U1 | 12/2003 |
| FR | 2 182 235 A | 12/1973 |

* cited by examiner

*Primary Examiner* — Lars A Olson
(74) *Attorney, Agent, or Firm* — Barnes & Thornburg LLP

(57) ABSTRACT

An underwater viewing unit includes a tube insertable into a through-hole of an air mattress, a rest for the viewer's head provided at the lower end of the tube, and a transparent panedisposed within the tube. The head rest is formed by an inflatable beaded body connected to the upper rim of the tube and extending over less than 360° to leave free a peripheral region outside the tube for free breathing.

15 Claims, 2 Drawing Sheets

UNDERWATER VIEWING UNIT FOR AN AIR MATTRESS

BACKGROUND OF THE INVENTION

Snorkels and diving goggles have been used for decades for observing the underwater world. Still, many people know images of fish and corals only from TV or aquarium.

For snorkeling, the person wears diving goggles and a snorkel and floats in the water face-down with or without fins. In this position, the diver is 90% within or under the water. Diving suits and swimming aids reduce the immersion; the face, the ears or the entire head will always remain immersed.

To exercise this kind of diving, the person needs some practice. The diving goggles must be closely fitted to the face to avoid the ingression of water. The head strap must not be too taut or too lose. The snorkel must be in the proper position to reduce the ingression of water. When exhaling, the snorkel must be regularly blown free to keep the inhaled air flow free of water. Persons suffering from claustrophobia cannot wear diving goggles. Persons with sensible ears avoid getting their ears wet. Many people, specifically women, do not want to wet their hair or ruin it by wearing diving goggles, and to some people, the water is simply too cold to immerse therein completely.

For these reasons, diving goggles are used as a batiscope (water glasses, viewing funnel) in connection with air mattresses. In this case, the person lies on the air mattress, basking and viewing the underwater world through diving goggles which are simply held in front of the face. In this case, however, breathing without a snorkel will become a problem because the face is too deeply immersed.

Air mattresses made of a transparent sheet or having transparent portions are offered in the market. The viewing quality, however, is very low because the sheet is curved and not clear and because air bubbles form under the mattress which distort the image.

DE 203 15 281 U1 discloses an air mattress with an insertable underwater viewing unit which includes a tube insertable into a through-hole of an air mattress, a rest for a viewer's head provided at the upper end of the tube, and a transparent pane disposed within the tube.

SUMMARY OF THE INVENTION

The invention is based on the general object of improving the known underwater viewing unit. A more specific object may be seen to reside in providing an apparatus which renders viewing the underwater world as agreeable and simple as possible, is easy to manufacture and simple to use.

A solution to this object is achieved by means of the underwater viewing unit defined in claim comprising a tube insertable into a through-hole of an air mattress, a rest for a viewer's head provided at the upper end of the tube, and transparent pane disposed within the tube, wherein the head rest includes an inflatable beaded body connected to the upper rim of the tube and surrounding the same by less than 360°.

With the device thus structured, the viewer's head rests on an inflatable beaded body which is soft and conforms itself to the shape of the head, and which is connected to the upper rim of a tube inserted in a through-hole of the air mattress. The beaded body extends through an angle of less than 360° to leave space for the nose and mouth so that the viewer can breathe freely.

The tube is preferably in the form of a truncated cone having a concavely curved peripheral surface, with the smaller dimension of the cone at the upper end of the tube.

This adaptation of the viewing opening to the viewer's head results in a larger angle of vision.

In an embodiment, an inflatable toroidal beaded ring is connected the a lower end of the tube. The viewing unit is clamped to the through-hole of the air mattress by inflating the two beaded bodies provided at the upper and lower end of the tube.

In a further embodiment, the pane is fixed to the beaded ring and is held within in a resilient frame fitted to of the beaded ring. A plurality of spacers provided at a lower side of the beaded ring and projecting downward beyond the lower surface of the pane protect the pane against damage from below.

BRIEF DESCRIPTION OF THE DRAWINGS

In the attached drawings.

DESCRIPTION OF AN EMBODIMENT

Figure 1:
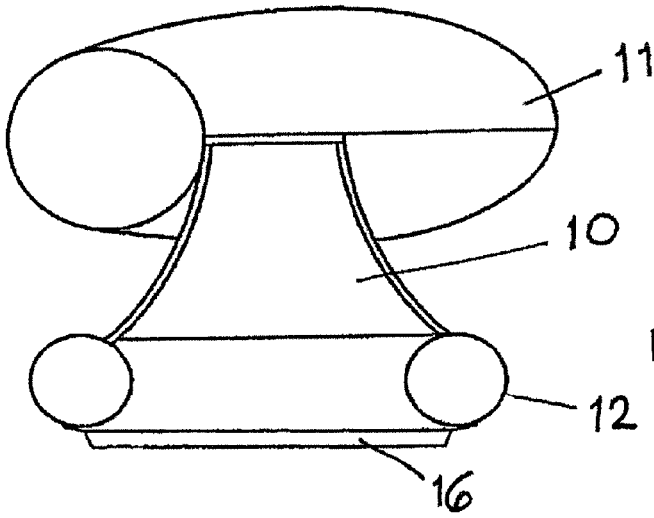
FIG. 1 is a vertical section through an underwater viewing unit in accordance with an embodiment of the invention.

The underwater viewing unit shown in FIGS. 1 to 4 consist essentially of a generally frusto-conical tube 10, a head rest having the form of an inflatable beaded body 11 connected to the upper rim of the tube, and an inflated beaded ring 12 connected to the lower rim of tube 10. The frusto-conical surface of the tube 10 widens from a smaller viewing opening surrounded by the upper rim, with a concavely curved outer surface 13 toward a larger opening surrounded by the lower rim and closed by a transparent pane 14. In use, the pane 14 is below the water surface.

While the lower beaded ring 12 is formed as a closed circular or oval torus, the beaded body 11 extends circumferentially over less than 360° to leave free a corresponding circumferential region 15.

The connections between the tube 10, the beaded body 11 and the beaded ring 12 consist in water-tight welds. The pane 14 has a sharp-edged rim which is clamped into an inward open groove of a frame 16 of elastomeric material welded to the lower side of the beaded ring 12.

The lower side of the frame 16 is formed with a plurality of (four in the embodiment) circumferentially distributed spacers 17 which project beyond the lower surface of the pane 14 to protect the pane against damage.

Figure 5:
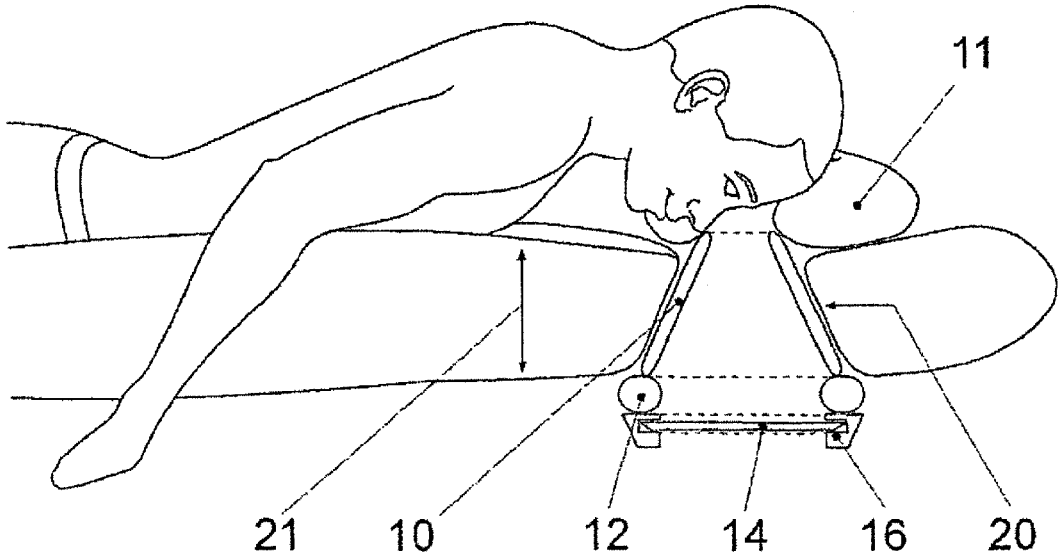
FIG. 5 is a cross-sectional view of the viewing unit inserted in an air mattress.

In use, the viewing unit, in its uninflated condition, is inserted into a through-hole 20 of an air mattress 21, as shown in FIG. 5, to such an extent that the beaded body 11 is situated above the upper surface of the air mattress 21 and the beaded ring 12 is below the lower surface thereof. When inflated, the beaded bodies 11, 12 are applied against these surfaces of the air mattress 21 so that the viewing unit is fixedly clamped. Thereafter, the pane 14 is clamped into the frame 16.

The upper viewing opening defined by the tube 10 and the beaded body 11 is so dimensioned that it encloses substantially only the eye area whereas the mouth and nose are in the circumferential area 15 which is left free by the beaded body 11 and are thus exposed to the atmosphere for free breathing.

Figure 2:
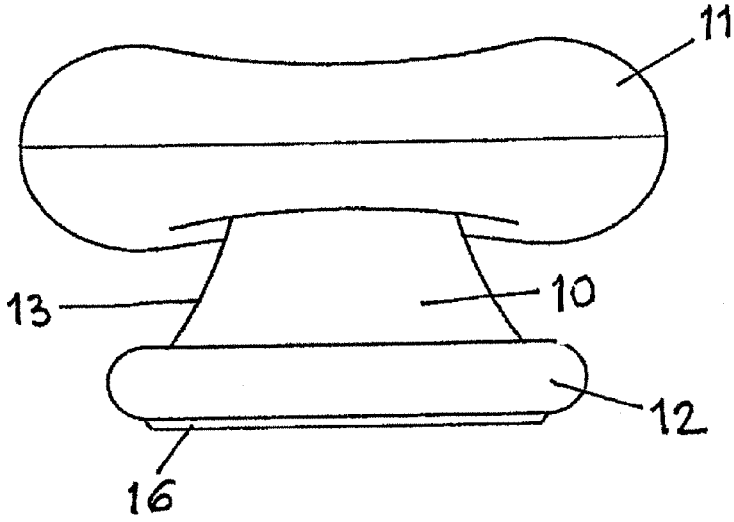
FIG. 2 is a side view of the viewing unit.
Figure 3:
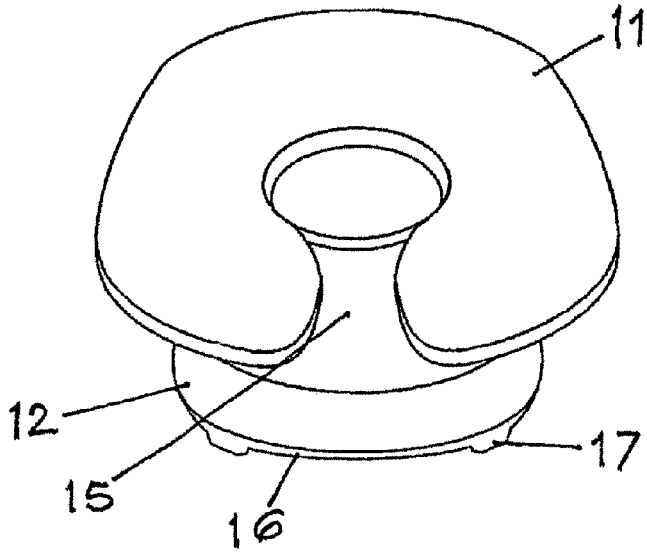
FIG. 3 is a perspective view seen at an angle from above and from the front.
Figure 4:
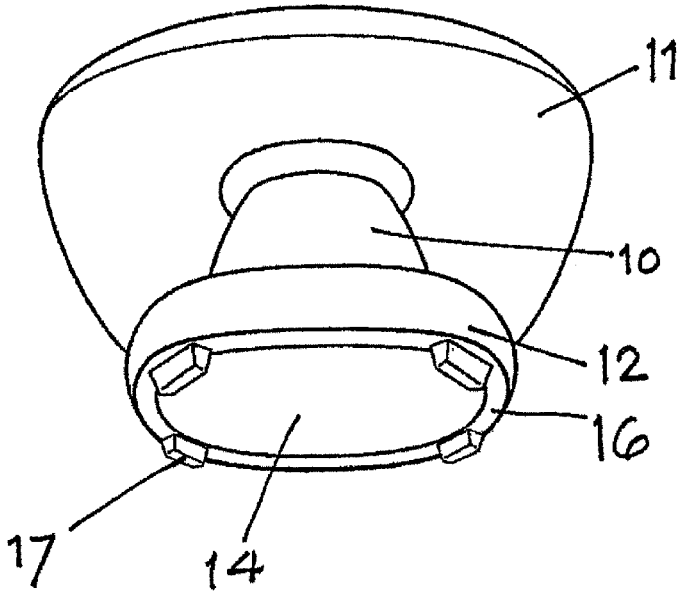
FIG. 4 is a perspective view seen at an angle from the rear and from below.

As shown in FIG. 2, the tube 10 may be formed as a double-walled structure. In this case, it may also be inflated so that the entire viewing unit forms an inherently stable structure. This ensures a free view through the tube 10 even if the tube is not completely adapted to the width of the through-hole 20 and the thickness of the air mattress 21.

The invention claimed is:

1. An underwater viewing unit comprising:

a tube insertable into a through-hole provided in the body of an air mattress;

a rest for a viewer's head provided at the upper end of the tube; and a transparent pane disposed within the tube, wherein the head rest includes an inflatable beaded body connected to an upper rim of the tube and surrounding the upper rim by less than 360°, wherein the unit further comprises an inflatable toroidal beaded ring connected to a lower rim of the tube.

2. The viewing unit of claim 1, wherein the pane is fixed to the toroidal beaded ring.

3. The viewing unit of claim 2, including a plurality of spacers provided at a lower side of the beaded ring and projecting downward beyond a lower surface of the pane.

4. The viewing unit of claim 1, wherein the pane is held within a resilient frame fitted to the lower side of the beaded ring.

5. The viewing unit of claim 4, including a plurality of spacers provided at the lower side of the beaded ring and projecting downward beyond a lower surface of the pane.

6. An underwater viewing unit comprising:

a tube insertable into a through-hole of an air mattress;

a rest for a viewer's head including an inflatable beaded body connected to an upper rim of the tube and surrounding the upper rim by less than 360°;

an inflatable toroidal beaded ring connected to a lower rim of the tube; and a transparent pane disposed within the tube.

7. The viewing unit of claim 6, wherein the tube is a double-walled inflatable body.

8. The viewing unit of claim 6, wherein the tube is substantially in the form of a truncated cone with its smaller dimension at the upper rim of the tube.

9. The viewing unit of claim 8, wherein the truncated cone has a concavely curved peripheral surface.

10. The viewing unit of claim 6, wherein the pane is fixed to the toroidal beaded ring.

11. The viewing unit of claim 10, including a plurality of spacers provided at a lower side of the beaded ring and projecting downward beyond a lower surface of the pane.

12. The viewing unit of claim 6, wherein the pane is held within a resilient frame fitted to the lower side of the beaded ring.

13. The viewing unit of claim 12, including a plurality of spacers provided at a lower side of the beaded ring and projecting downward beyond a lower surface of the pane.

14. The viewing unit of claim 6, wherein the tube is substantially in the form of a truncated cone with its smaller dimension at the upper rim of the tube.

15. The viewing unit of claim 14, wherein the truncated cone has a concavely curved peripheral surface.

* * * * *